United States Patent [19]

O'young

[11] Patent Number: 4,906,217

[45] Date of Patent: Mar. 6, 1990

[54] TOY ORNAMENT INCORPORATING SIMULATED RAIN FALL

[76] Inventor: S.J. O'YOUNG, No. 40, Alley 17, Lane 12, Chong Shan 11th St., Tainan, Taiwan

[21] Appl. No.: 223,884

[22] Filed: Jul. 25, 1988

[51] Int. Cl.[4] ..... A63H 23/08; A63H 23/00

[52] U.S. Cl. ..... 446/267; 446/153

[58] Field of Search ..... 446/267, 153

[56] References Cited

U.S. PATENT DOCUMENTS

| | | | |
|---|---|---|---|
| 479,530 | 7/1892 | Roberts | 446/267 |
| 1,341,985 | 6/1920 | Kemp | 446/267 |
| 1,503,546 | 8/1924 | Menzies | 446/267 |
| 1,855,138 | 4/1932 | Rebb | 446/267 |
| 2,315,240 | 3/1943 | Ashenberg | 446/267 |
| 2,500,098 | 3/1950 | Soss | 446/267 |
| 2,540,502 | 2/1951 | Aschbacher | 446/267 |
| 2,549,392 | 4/1951 | Sheridan | 446/267 |
| 2,848,822 | 8/1958 | Morse | 446/267 |
| 2,996,831 | 8/1961 | Woron | 446/267 |
| 3,009,286 | 11/1961 | Warner | 446/267 |
| 4,032,141 | 6/1977 | Tanimura | 446/267 |

*Primary Examiner*—Robert A. Hafer
*Assistant Examiner*—Michael Brown

[57] ABSTRACT

An observe/reverse link convection siphon toy ornament with three layers and four chambers device to be connected by special channel to attain the effect of balance between the fluid and air, the normal state of the flow of the fluid is able to be changed without externally applying power of a cell, and varied cards, such as, doll, cartoon, asdvertisement, etc., may be installed in it arbitrarily to fulfill the purpose of playing, seeing and enjoying.

1 Claim, 5 Drawing Sheets

TOY ORNAMENT INCORPORATING SIMULATED RAIN FALL

BACKGROUND AND SUMMARY OF THE INVENTION

This invention relates to a toy ornament in the form of a closed transparent liquid housing having two oppositely-facing pictures arranged therein for external viewing. Liquid passage mechanisms within the housing cause liquid to gravitationally drip from an upper end of the housing as a simulated rain curtain in front of one of the pictures. By turning the housing end-for-end (so that the bottom end becomes the top end) a different gravitational flow pattern is achieved in the form of a second simulated rain curtain in front of the other picture.

THE DRAWINGS

DESCRIPTION OF A PREFERRED EMBODIMENT OF THE INVENTION

Figure 1:
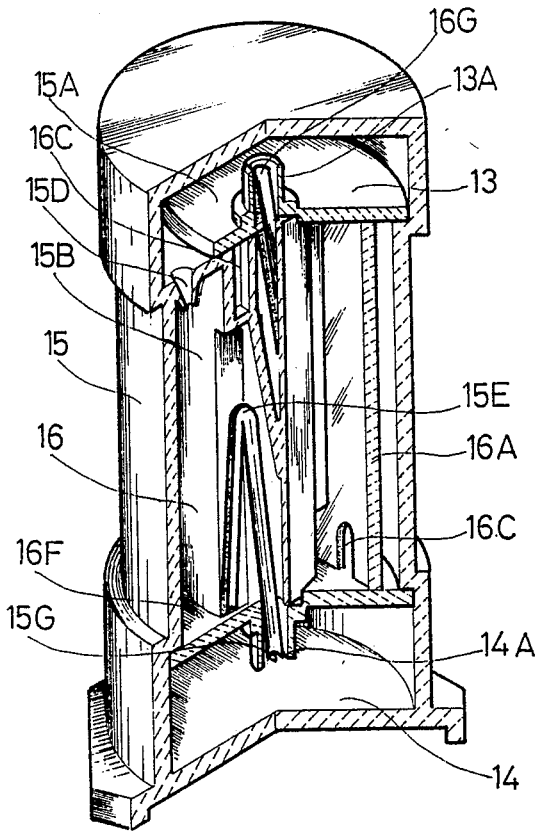
FIG. 1 is a sectional view of a structure embodying the invention, taken on plane (line) B—B in FIG. 4.

The drawings illustrate a toy ornament that includes a transparent closed housing of cylindrical tubular configuration. The transparent tubular side wall of the housing defines a central longitudinal axis (vertical axis in the drawings).

Figure 2:
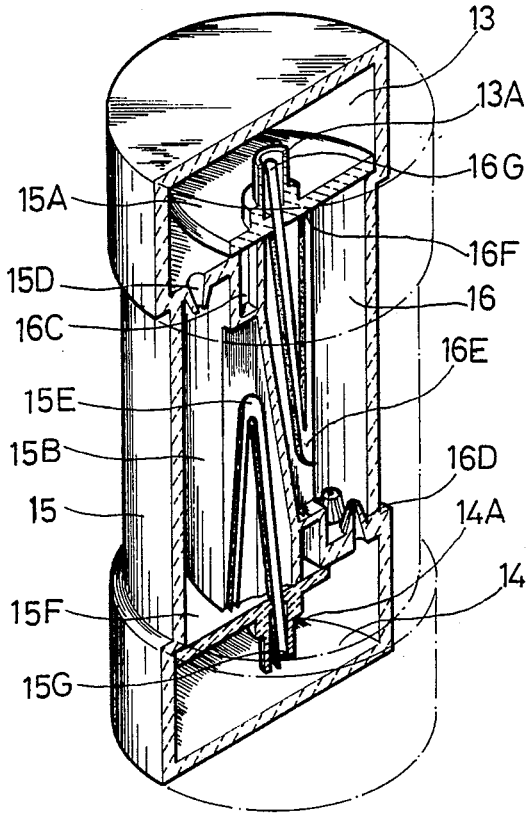
FIG. 2 is a sectional view taken along plane (line) A—A in FIG. 4.

The housing is subdivided into two end chambers 13 and 14, and a central chamber (at 15,16) by means of two transverse partitions; one of the transverse partitions is denoted by numeral 15A in FIGS. 1 and 2.

Figure 5:
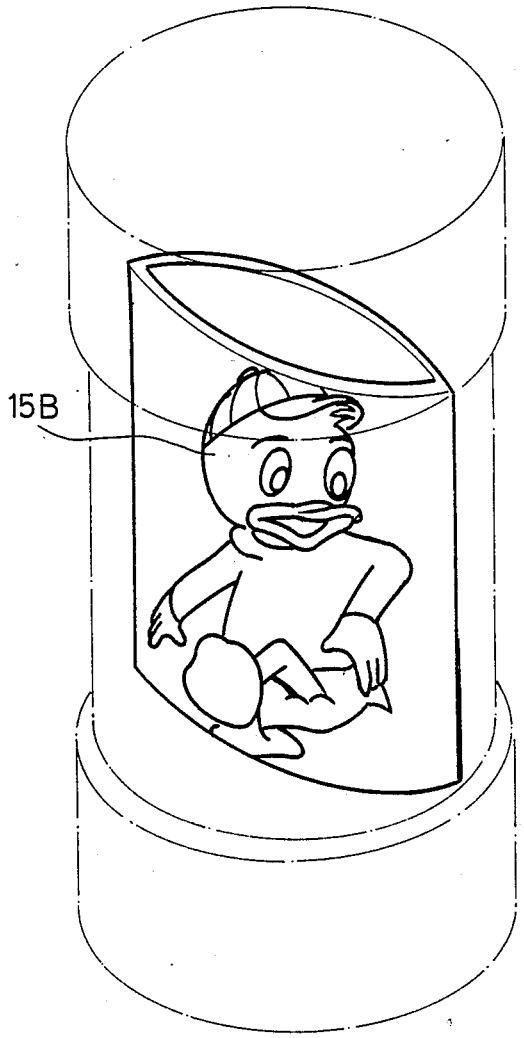
FIG. 5 is a view similar to FIG. 4, but illustrating an interior structural detail within the depicted ornament.

As best shown in FIG. 5, two upstanding interior curved walls are arranged within the central chamber. A distinctive picture of a doll, person, cartoon character, or other type of scenery, appears on the outer surface of each one of the curved walls for viewing from points external to the housing; numerals 16A and 15B in FIGS. 1 and 3 reference the curved walls and associated pictures. The curved walls are spaced inwardly from the transparent tubular side wall of the housing; the internal space between each curved wall and the inner surface of the housing side wall is sometimes hereinafter termed a "scenic space." There are two pictures facing in opposite directions, and two associated scenic spaces.

Figure 3:
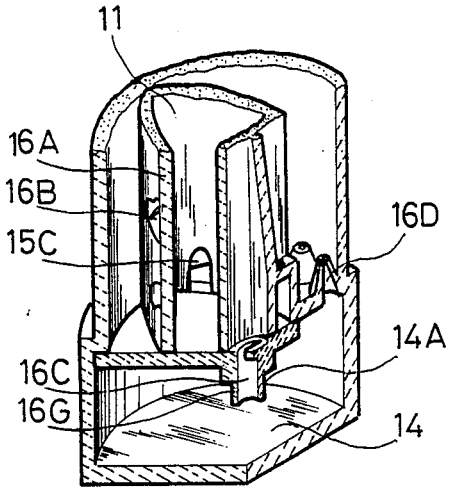
FIG. 3 is a fragmentary sectional view taken along plane (line) C—C in FIG. 4.
Figure 4:
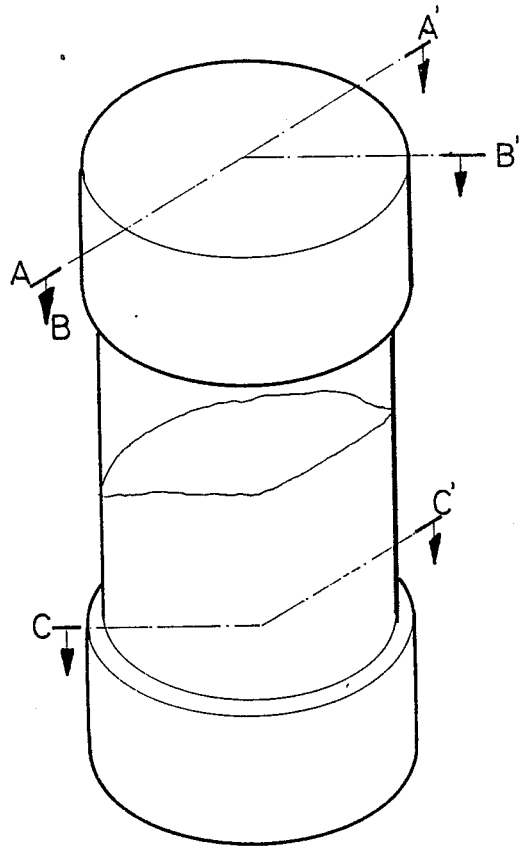
FIG. 4 is a perspective external view of a toy ornament constructed according to the invention.

Still referring to FIG. 5, it will be seen that the two curved walls circumscribe a central vertical space that is concealed from external view by the curved walls; in FIG. 3 the central space is referenced by numeral 11. Two U-shaped suction tubes (to be described later) are located within this central circumscribed space; these suction tubes are concealed and hence not apparent to persons viewing the ornament.

Liquid, for example water, is charged into the closed tubular housing in sufficient volume to fill one of the end chambers 13 or 14. Under static conditions (no movement of the tubular housing) the liquid will occupy (fill) the lowermost end chamber, i.e. chamber 14 in FIGS. 1 and 2. If the tubular housing is overturned so that end chamber 14 becomes the so-called top chamber, the liquid within chamber 14 will gravitationally leak out of chamber 14 through drip holes 16D (FIG. 2). There are a multiplicity of holes 16D, such that the downflow of liquid simulates falling rain. Holes 16D communicate with one of the aforementioned scenic spaces, such that the simulated rain is located in front of the associated picture.

The other transverse partition 15 has a multiplicity of drip holes 15D extending therethrough for gravitational discharge of simulated rain from end chamber 13 into the "scenic space" in front of the other picture, when the tubular housing is returned to the FIG. 1 position.

In each case, the simulated rain accumulates in the central chamber, gradually building up to provide a raised liquid level in the central chamber (at 15,16). Vent holes 15C and 16C extend through curved walls 15B and 16A, such that the same liquid level prevails in central space 11 and the associated scenic space.

Within the central concealed space there are provided two U-shaped suction tubes. One of these suction tubes includes a relatively short leg that terminates in a suction opening 16F near transverse partition 15A (FIG. 2); a U-bend 16E leads to a relatively long leg that extends through partition 15A. The relatively long leg of the suction tube terminates in a liquid exhaust opening 16G within chamber 13. The long leg of the suction tube has a sealed connection with partition 15A such that liquid can flow into chamber 13 only through the suction tube.

The second suction tube is similar constructionally to the first suction tube, except that is differently oriented within the tubular housing. The second suction tube includes a relatively short leg that terminates in a suction opening 16F located within the central chamber near the other transverse partition (FIG. 1); a U-bend 15E leads from the short leg to a relatively long leg that extends through the transverse partition into tend chamber 14. The long leg of the second suction tube terminates in a liquid exhaust opening 15G. The central space 11 that contains the two suction tubes is subdivided by a partition, such that the two suction tubes are isolated from each other, as shown in FIGS. 1 and 2.

Each suction tube transfers liquid from the central chamber to one of the end chambers 13 or 14. For example, if the tubular housing is in the FIG. 1 position, and liquid builds up to a level above U-bend 15E, the liquid outside the short leg of the suction tube provides a greater head than the liquid within the short leg; atmospheric pressure within the central chamber is then sufficient to start a flow through the suction tube into chamber 14. Openings 16D vent any excess pressure that might otherwise build up within chamber 14. The suction flow is continued because the discharge leg of the tube is longer than the intake (shorter) leg.

The other suction tube operates in the same manner as above described, the difference being that the other suction tube transfers liquid form the central chamber into the other end chamber 13 (when the tubular housing is reversed form its FIG. 1 position).

The liquid emptying action (form the central chamber to an end chamber) occurs without any apparent cause (because the suction tubes are concealed). This adds to the mysteriousness of the event and wonderment on the part of the viewer.

I claim:

1. A toy ornament comprising a transparent closed housing that includes a tubular side wall defining a central axis; first and second axially spaced transverse partitions (15A) separating said housing into a first end chamber (13), a second end chamber (14), and a central chamber therebetween; wall means within said central chamber defining two oppositely facing pictures (15B and 16A) located between the central axis and the tubular side wall to define two separate scenic spaces; said pictures circumscribing a central space that is concealed from external view; first liquid drip holes extending through said first transverse partitions for gravitationally delivering a simulated flow of rain from the associated first end chamber to one of the scenic spaces; second liquid drip holes extending through said second transverse partition for gravitationally delivering a simulated flow of rain from said second end chamber to the other scenic space when the housing is turned end for end; a first U-shaped siphon tube located within the central space circumscribed by the pictures; said first siphon tube comprising a relatively short leg having a suction opening communicating with the central space near said first transverse partition, and a relatively long leg extending through said first transverse partition into the associated first end chamber; a second U-shaped siphon tube located within the central space circumscribed by the pictures; said second siphon tube comprising a relatively short leg having a suction opening communicating with the central space near the second transverse partition, and a relatively long leg extending through said second transverse partition into the second end chamber; and a liquid disposed in the housing for gravitational flow through the drip holes, and suction flow through the suction tubes.

* * * * *